US012114793B2

(12) United States Patent
Foley

(10) Patent No.: US 12,114,793 B2
(45) Date of Patent: Oct. 15, 2024

(54) PORTABLE DRINKING DEVICE

(71) Applicant: Chug Bud, LLC, Los Angeles, CA (US)

(72) Inventor: Benjamin Foley, Los Angeles, CA (US)

(73) Assignee: CHUG BUD, LLC, Los Angeles, CA (US)

( * ) Notice: Subject to any disclaimer, the term of this patent is extended or adjusted under 35 U.S.C. 154(b) by 201 days.

(21) Appl. No.: 17/513,723

(22) Filed: Oct. 28, 2021

(65) Prior Publication Data

US 2023/0135732 A1 May 4, 2023

(51) Int. Cl.
*A47G 23/02* (2006.01)
*A47G 21/18* (2006.01)

(52) U.S. Cl.
CPC ..... *A47G 23/0266* (2013.01); *A47G 21/181* (2013.01); *B65D 2517/0049* (2013.01)

(58) Field of Classification Search
CPC ..... A47G 23/0266; A47G 19/2222; A47G 21/184; A47G 21/18; B65D 81/3876; B65D 81/3879; B65D 81/3881; B65D 81/3883; B65D 81/3886; B65D 81/3888; B65D 81/389; B65D 81/3893; B65D 81/3895; B65D 81/3897
See application file for complete search history.

(56) References Cited

U.S. PATENT DOCUMENTS

| | | | | |
|---|---|---|---|---|
| 10,278,526 | B2 * | 5/2019 | Stirbis | A47G 19/22 |
| 2005/0035005 | A1 * | 2/2005 | Thomas | A45C 1/06 206/38.1 |
| 2012/0111930 | A1 * | 5/2012 | Maistrellis | B42F 21/06 283/37 |
| 2016/0083168 | A1 * | 3/2016 | Fernandez de Castro | B65D 25/08 206/222 |

* cited by examiner

*Primary Examiner* — Javier A Pagan
(74) *Attorney, Agent, or Firm* — Workman Nydegger

(57) ABSTRACT

A portable drinking device capable of fitting over a typical pressurized beverage can to direct the flow of fluid from the can into a user's mouth. The portable drinking device may be positioned over the open top of a can. The portable drinking device and can are then slightly tilted sideways. A piercing device, which is stored in a storage area formed in a funnel-like cap of the portable drinking device, is used to puncture a whole in the side of the can after the drinking device and can are tilted sideways. Either just before or immediately after the can is pierced, the entire assembly is positioned so that the portable drinking device directs a rapid stream of fluid from the punctured can through the tube of the portable drinking device into a user's mouth.

16 Claims, 6 Drawing Sheets

PORTABLE DRINKING DEVICE

FIELD OF THE DISCLOSURE

The present disclosure relates to portable drinking devices, particularly drinking devices that allow a user to quickly consume a beverage which may be contained in a pressurized can and a method for using the same.

BACKGROUND

"Shotgunning" is a well-known method of quickly consuming a beverage from a pressurized can by punching a hole in the side of the can. In that method, the pressurized can is usually held in a horizontal direction and tilted slightly. A small hole is punched in the side of the can close to the bottom, ideally puncturing the can in the air pocket which results from the slight tilt of the can. The hole can be made with any sharp object such as a key, bottle opener, pen, knife, or the like. After the hole is punched, the user then places his or her mouth over the hole while rotating the can to an upright position. The user then pulls the tab on the can and the pressurized liquid quickly drains through the hole into the user's mouth.

U.S. Patent Pub. No. 2009/0120968 A1 discloses a device having multiple purposes, including serving as a fast pour beverage tap. That tubular device contains a piercing end at one end and a mouthpiece on the other. The piercing end is designed to puncture a pressurized can or bottle and remain in the can or bottle. After puncturing, the mouthpiece end is inserted into a user's mouth and the tab on the can is pulled causing a high-speed gravity release of liquid. The tubular device may also be used as a smoking apparatus.

U.S. Pat. No. 7,784,361 discloses a more sophisticated device described as an electronic fluid dispensing apparatus having a tube with a funnel connected at one end and a differential pressure sensor at the other. An additional tube is attached to the first tube in the vicinity of the sensor. When a fluid is poured into the funnel, it passes through the tube and, by way of the sensor, the flow of fluid through the additional tube is controlled.

Consumption of beverages by such methods and using such devices has been prevalent primarily among college students and young adults as an alternative method of consuming beverages quickly and, in several instances, as part of a drinking game. Some traditional shotgunning methods and the above known devices usually result in the aeration of the beverage, causing more foam and bubbles than is desired. In addition, a certain amount of spillage still occurs after the tab on the can is pulled because the pressure at which the fluid flows out of the can through the location of the puncture is very high.

U.S. Pat. No. 10,058,203, which is hereby incorporated by reference as if fully set forth herein, discloses a portable drinking device that can fit over a pressurized beverage can to direct flow of fluid from the can to the recipient's mouth. After the device is positioned over the open top of a can and the end of the can is tilted sideways, the can may be punctured with a piercing device that is attached to the drinking device with a rope-like element to release the contents of the can into the user's mouth. The disclosed device is an improvement over previous devices for several reasons. However, the piercing element may freely dangle from the device. Moreover, if the rope-like element breaks, the piercing device is likely to be lost.

The portable drinking device of the present patent document provides a simple and portable drinking device which addresses, or at least mitigates, one or more of the problems associated with known devices and methods.

SUMMARY

The present patent document discloses a simple and portable drinking device that is capable of fitting over a typical pressurized beverage can to direct the flow of fluid from the can to a recipient or user's mouth. Once the pressurized can is opened, the portable drinking device may be positioned over the open top of the can and the entire assembly may be slightly tilted sideways. A piercing device, which is stored in a storage area formed in a funnel-like cap of the portable drinking device, is used to puncture a whole in the side of the can after the drinking device and can are tilted sideways. Either just before or immediately after the can is pierced, the entire assembly is positioned so that the portable drinking device directs a rapid stream of fluid from the punctured can through the tube of the portable drinking device and into a user's mouth.

This portable drinking device allows a known quantity of fluid to flow freely while eliminating a substantial amount of aeration and the foam by-product often associated with some prior devices. The portable drinking device may also include a storage space for the piercing device so that it does not dangle from the drinking device when not in use.

Further aspects, objects, desirable features, and advantages of the various inventions that are the subject of the present disclosure will become manifest and be better understood from the following description considered in connection with accompanying drawings in which various embodiments of the disclosed inventions are illustrated by way of example. It is to be expressly understood, however, that the drawings are for the purpose of illustration only and are not intended as a definition of the limits of any of the disclosed inventions.

DETAILED DESCRIPTION

Figure 1:
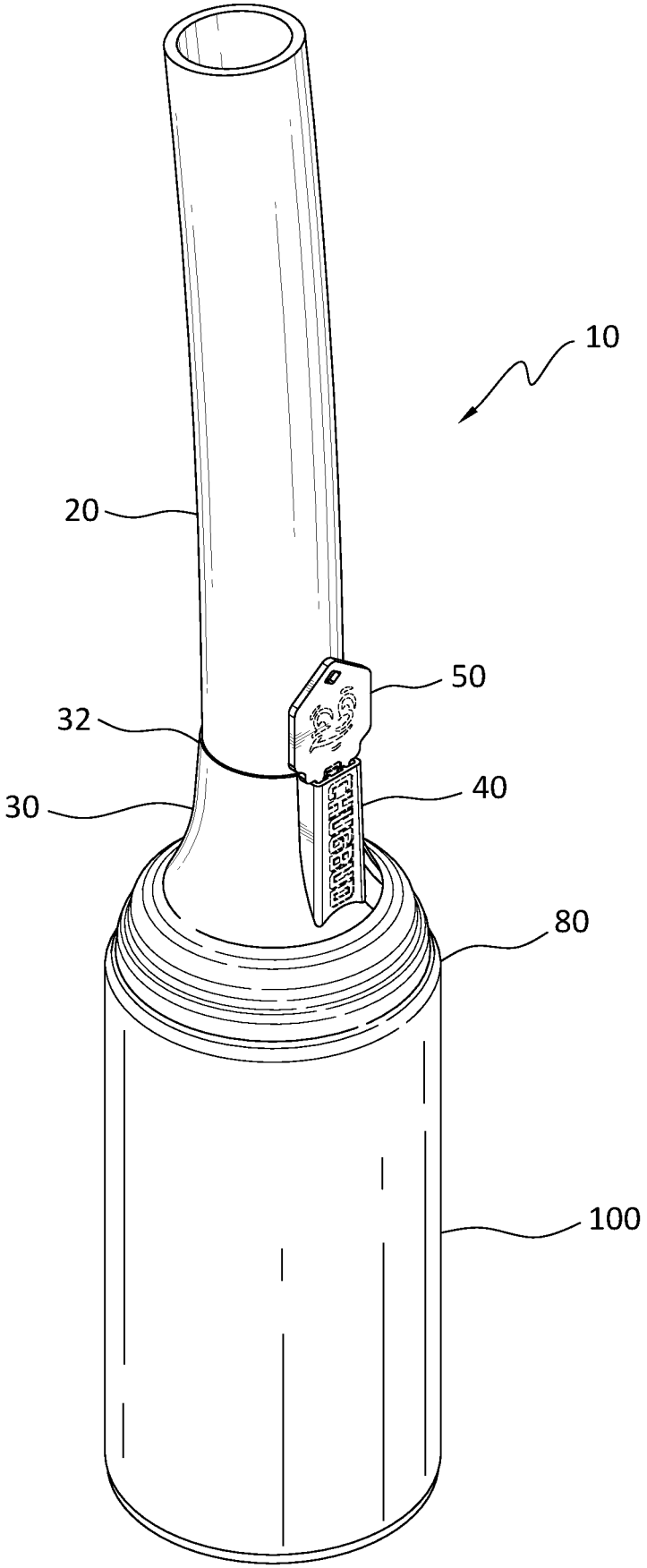
FIG. 1 is a left-front perspective view of an embodiment of a portable drinking device of the present patent document mounted on a typical beverage can.
Figure 2:
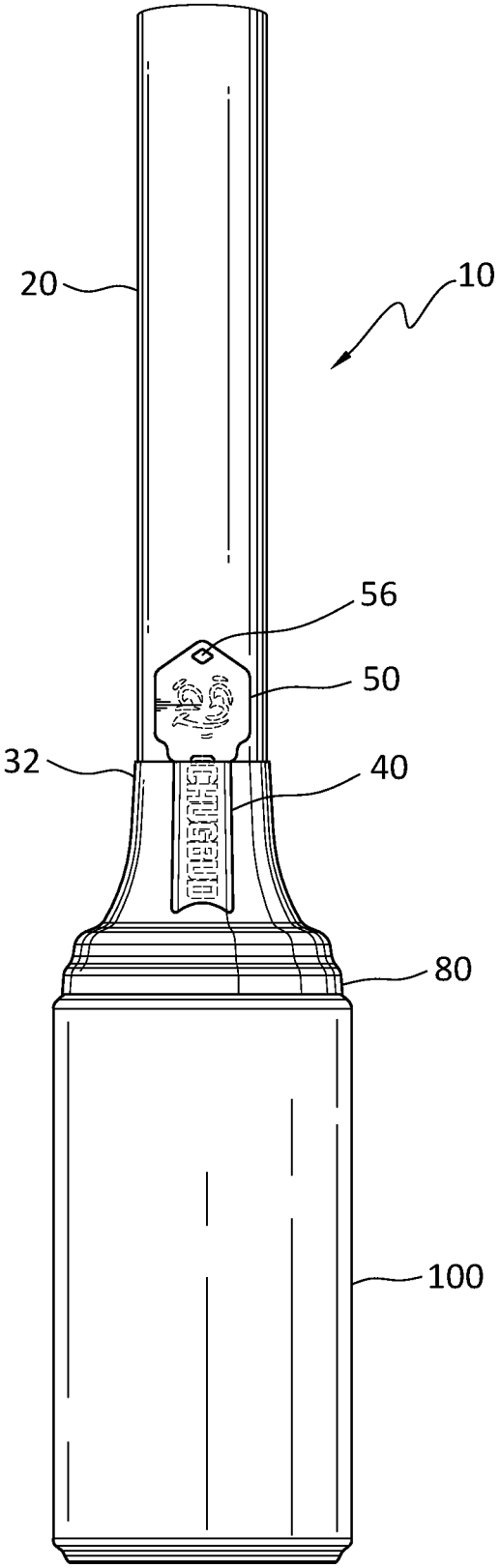
FIG. 2 is front view of the portable drinking device of FIG. 1.
Figure 3:
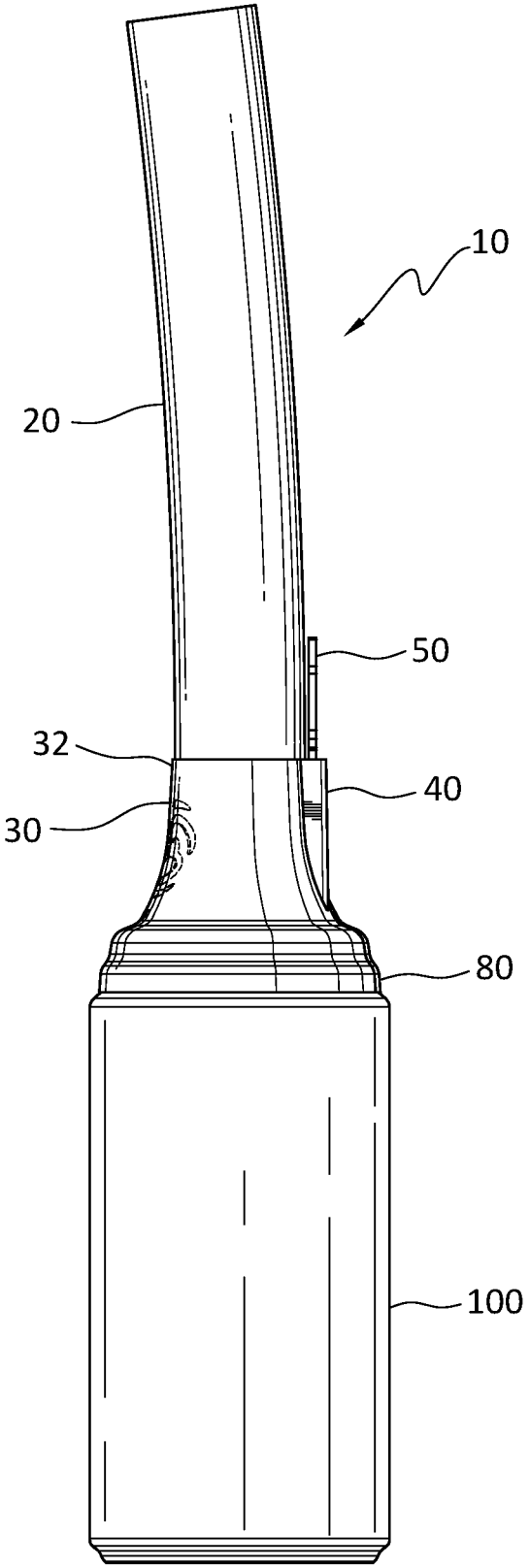
FIG. 3 is a left side view of the portable drinking device of FIG. 1.

A better understanding of different embodiments of the disclosure may be had from the following description read with the accompanying drawings in which like reference characters refer to like elements.

While the disclosure is susceptible to various modifications and alternative constructions, certain illustrative embodiments are in the drawings and are described below. The dimensions, angles, and curvatures represented in the figures introduced above are to be understood as exemplary and are not necessarily shown in proportion. The embodiments of the disclosure are adapted for a can or similar beverage container, and may be dimensioned to accommodate different types, shapes, and sizes of the same.

It should be understood, however, there is no intention to limit the disclosure to the specific embodiments disclosed, but on the contrary, the intention covers all modifications, alternative constructions, combinations, and equivalents falling within the spirit and scope of the disclosure. It is also to be understood that the terminology used herein is only for the purpose of describing particular embodiments of the present disclosure and is not intended to limit the scope of the disclosure.

A portable drinking device according to one embodiment of the present patent document is depicted in FIGS. 1-9. The portable drinking device 10 includes a tube 20 which has affixed at one end a generally rounded funnel-like cap 30. Cap 30 may be formed to include a storage area 40 that includes a receiving slot 42 that is sized to removably receive a portion of a piercing element 50. The receiving slot is preferably configured to form an interference fit with the portion of the piercing element that it is designed to receive. In the present embodiment, the piercing element 50 is shown as a key, and the receiving slot is configured to receive the shaft 52 of the key. In other embodiments the piercing element could be a bottle opener, pen, knife or other like object, that may be stowed in a suitably sized and shaped receiving slot 42 of storage area 40. In another aspect, while depicted in the illustrated embodiments as forming part of the cap 30, the storage area 40 and the receiving slot 42 may be provided on the tube 20.

While depicted in the illustrated embodiments as a rectangular recess having a single opening, the receiving slot 42 is not limited thereto. As indicated above, the receiving slot 42 may be sized and shaped according to the piercing element provided and/or additional considerations. For example, the receiving slot 42 may have a single opening or multiple openings, for example forming an elongate channel with an opening at a first end and an opposite second end. A receiving slot 42 having a circular profile or a profile that transitions from rectangular to circular are also contemplated. Further shapes, orientations, and configurations for suitably storing a piercing element are conceived, as would be understood by one skilled in the art from the teachings of the current disclosure.

Figure 4:
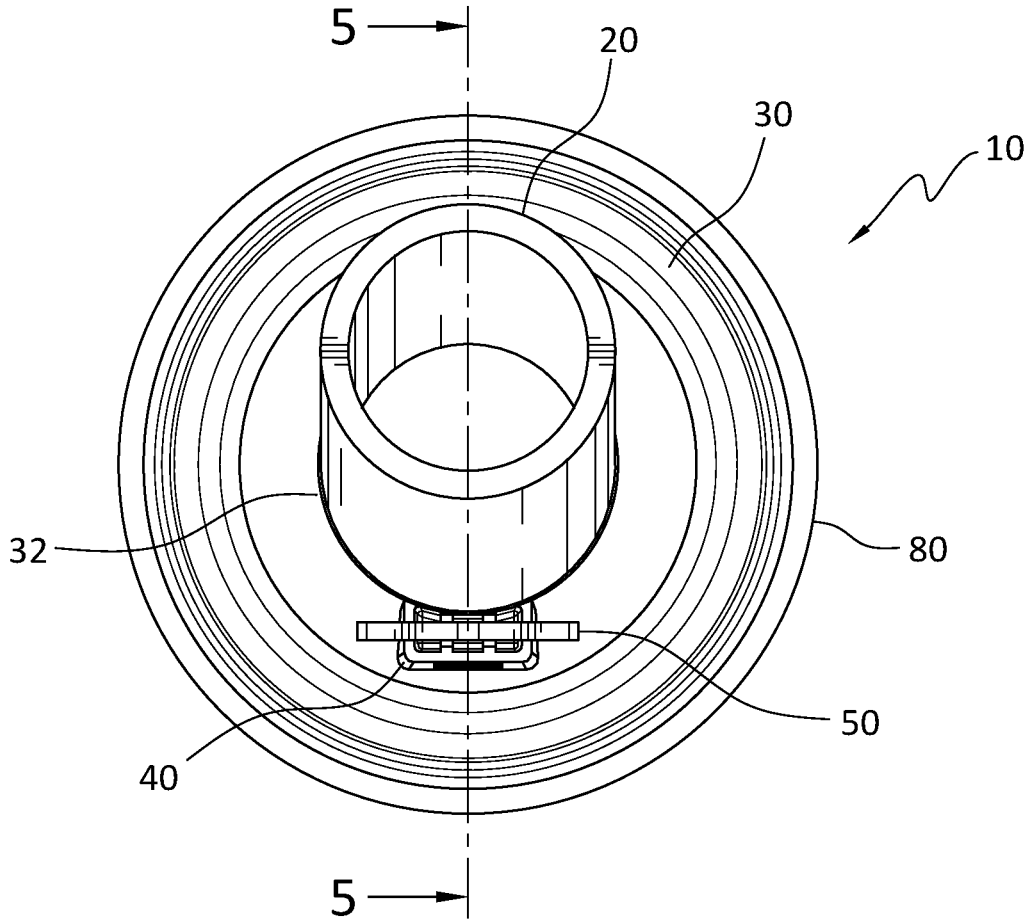
FIG. 4 is a top view of the portable drinking device of FIG. 1 of the present invention with the piercing element removably stored in a storage area of the device.

FIG. 4 is a top view of the portable drinking device 10, showing that tube 20 preferably has a diameter that is uniform throughout. In the preferred embodiment, tube 20 has a diameter of approximately 1 to 2 inches with a wall thickness of about 0.1 inch±0.05 inch. Tube 20 may have a length ranging from approximately 6 to 14 inches, and more preferably a length of approximately 7 to 8 inches. Tube 20 may be fabricated from a variety of food grade polymer materials having a degree of flexibility, such as polypropylene, polyurethane, polyvinyl chloride (PVC), silicone, nylon or other like materials. In one embodiment it may be made from a clear PVC material. According to alternative embodiments, the tube 20 may have a varying diameter along its length, for example a diameter that increases or decreases away from the cap 30.

As shown in FIGS. 1-5, the distal end of tube 20 is received in a proximal end 32 of a rounded funnel-like cap 30. As best seen in FIG. 6, the distal end of tube 20 is received in the proximal end 32 of cap 30 until the tube is stopped by annular shoulder 34 which is formed on the inner wall of the funnel-like cap 30 at a desired location. Cap 30 may be fabricated from any suitable food grade polymer having sufficient flexibility to removably receive and form a seal around can 100 at its distal end and can be suitably attached to tube 20 at its proximal end. Generally, the cap 30 will have a higher Durometer hardness than that of tube 20. A number of thermoplastic elastomers (TPE) are particularly well suited for fabricating cap 30 as they have both thermoplastic and elastomeric properties and are relatively easy to injection mold.

In varying embodiments, the inner diameter of the proximal end 32 of cap 30 in the area in which it is attached to tube 20 may be slightly smaller than the outer diameter of tube 20 so that an interference fit is created between the tube 20 and the inner surface 34 of the proximal end 32 of cap 30. This will allow tube 20 to be periodically removed from cap 30 for enhanced cleaning. Shoulder 34 may be located approximately 0.75 to 1.0 inches from the mouth at the proximal end 32 of cap 30 to help ensure that the interference fit is sufficiently strong that cap 30 does not become easily dislodged from tube 20 during use. Moreover, the interference fit preferably increases gradually from the mouth of cap 30 to shoulder 34. For example, the interference fit between the tube 20 and cap 30 may be in the range of 5 to 7 mils at the mouth of cap 30 and 18 to 22 mils proximate the shoulder 24, and midway between these two locations, the interference fit may be in the range of 7 to 10 mils.

Increasing the interference between the tube 20 and inner wall of cap 30 the further that tube 20 is inserted into cap 30 is beneficial because it allows tube 20 to be easily inserted into the mouth portion of the cap—which has the thinnest cross-sectional wall thickness as shown in FIG. 6—without damaging the mouth of cap 30 while also increasing the interference fit the further the tube is inserted into cap 30 until it reaches shoulder 34.

As an alternative to employing an interference fit as described above, in other embodiments, other techniques for affixing tube 20 to cap 30 may be used, including the use of adhesives or plastic welding.

Figure 5:
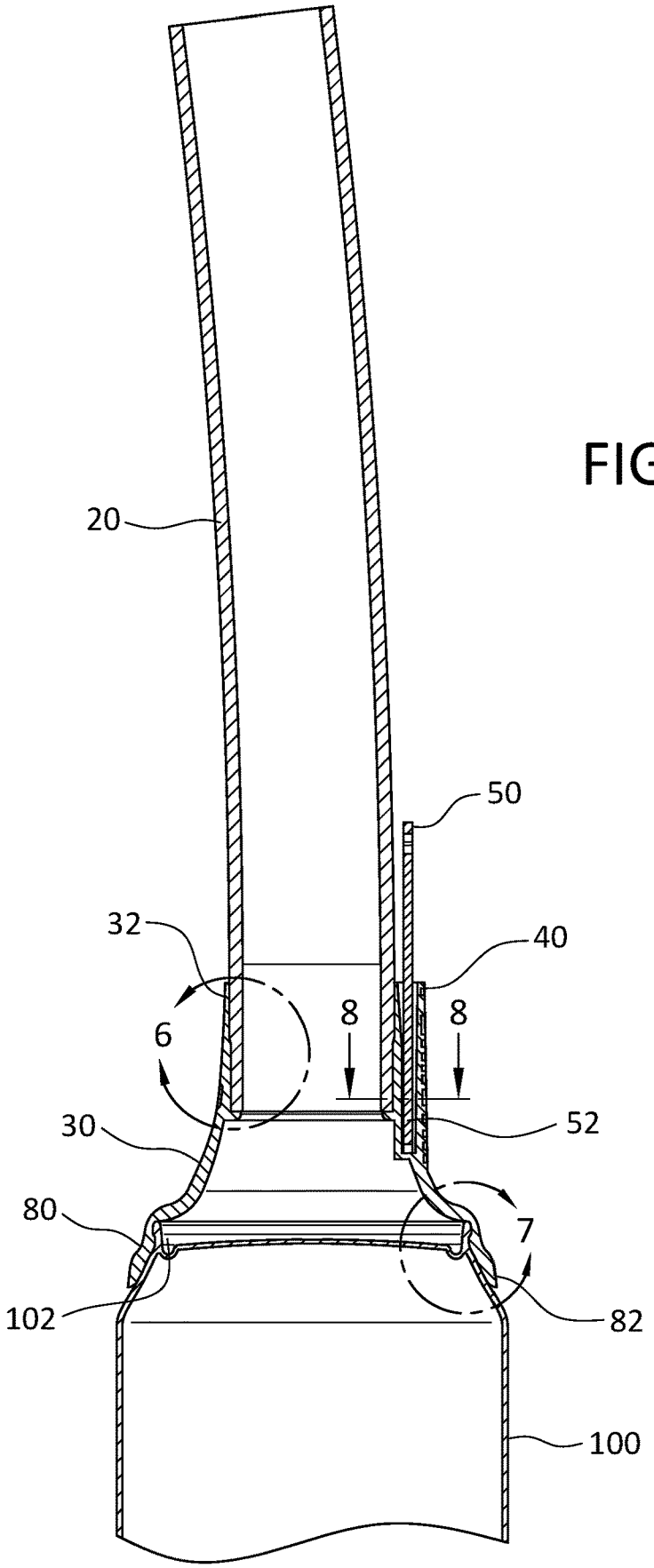
FIG. 5 is a cross-section though the portable drinking device taken along line 5-5 in FIG. 4.
Figure 6:
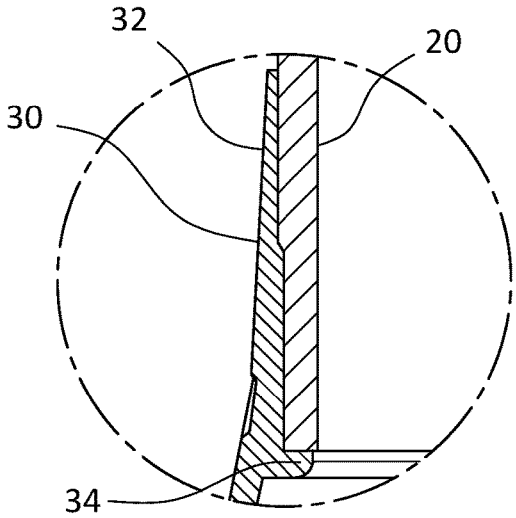
FIG. 6 is an enlarged view of the area shown in FIG. 5 that is circled with a 6.
Figure 7:
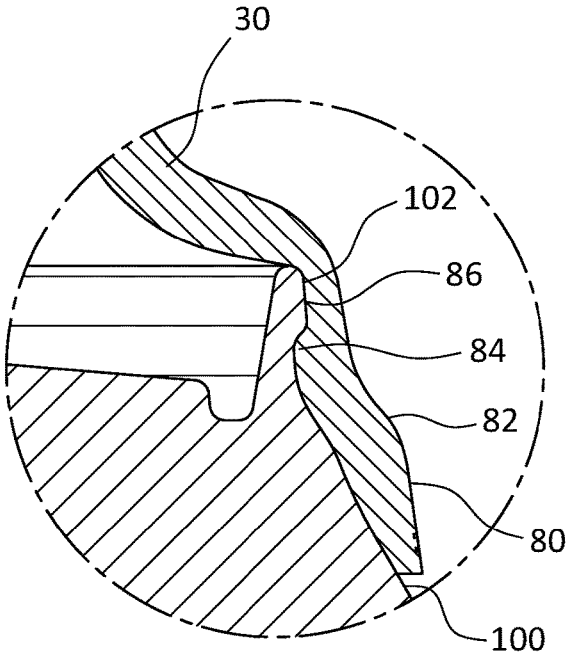
FIG. 7 is an enlarged view of the area shown in FIG. 5 that is circled with a 7.

As readily seen in FIGS. 1-5, cap 30 is a generally rounded funnel-like structure in which the diameter of the cap 30 at its distal end 80 is greater than the diameter of proximal end 32 which is attached to the tube 20. The diameter of the distal end 80 is sized to fit over the top of one or more sizes of pressurized beverage cans 100, such as a standard 12 oz. beverage can, the top lip 102 of which typically has an outer diameter of approximately 2.1 inches. The distal end 80 of cap 30 is preferably configured, as best seen in FIGS. 5 and 7, so that an inner surface of lip 82 forms an interference fit with the outer surface of can 100 so as to create a temporary seal around the top of can 100, including lip 102, when the portable drinking device 10 and can 100 are assembled. The inner wall of lip 82 preferably includes an annular recess 86 sized to form an interference fit with lip 102 of can 100. On the distal side of annular recess 85, a protrusion 84 is formed to form a snap seal with the distal edge of lip 102 of can 100. Because cap 30 is made from a suitable elastomeric material, however, can 100 can be readily removed after being inserted into the distal end of cap 30, for example, after the contents of can 30 have been emptied.

FIGS. 1-5 illustrate the portable drinking device 10 of the present disclosure after it has already been assembled with a pressurized can 100. As described in more detail below, the piercing element 50 may be removably stored in a storage area 40 formed in the outer wall of cap 30. In addition, if desired, piercing element may be attached to cap 30 with a string or other tethering element, for example, by wrapping one end of the tethering element around tube 20 where it meets cap 30 and attaching the other end of the tethering element to piercing element 50, such as by passing it through hole 56. Alternatively, to wrapping one end of the tethering element around tube 20 where it meets cap 30, an eyelet could be molded into cap 30, into the storage area 40, or into the tube 20 to allow one end of the tethering element to be anchored thereto. In like manner, the tethering element may be secured to the piercing element 50 by another means, such as by an adhesive or the like, rather than requiring a hole 56 in the piercing element. While a tethering element is not required with the portable drinking device 10 of the present patent document in view of storage area 40, the optional inclusion of such a tethering device may provide added security against the unintended loss of piercing element 50.

Figure 9:
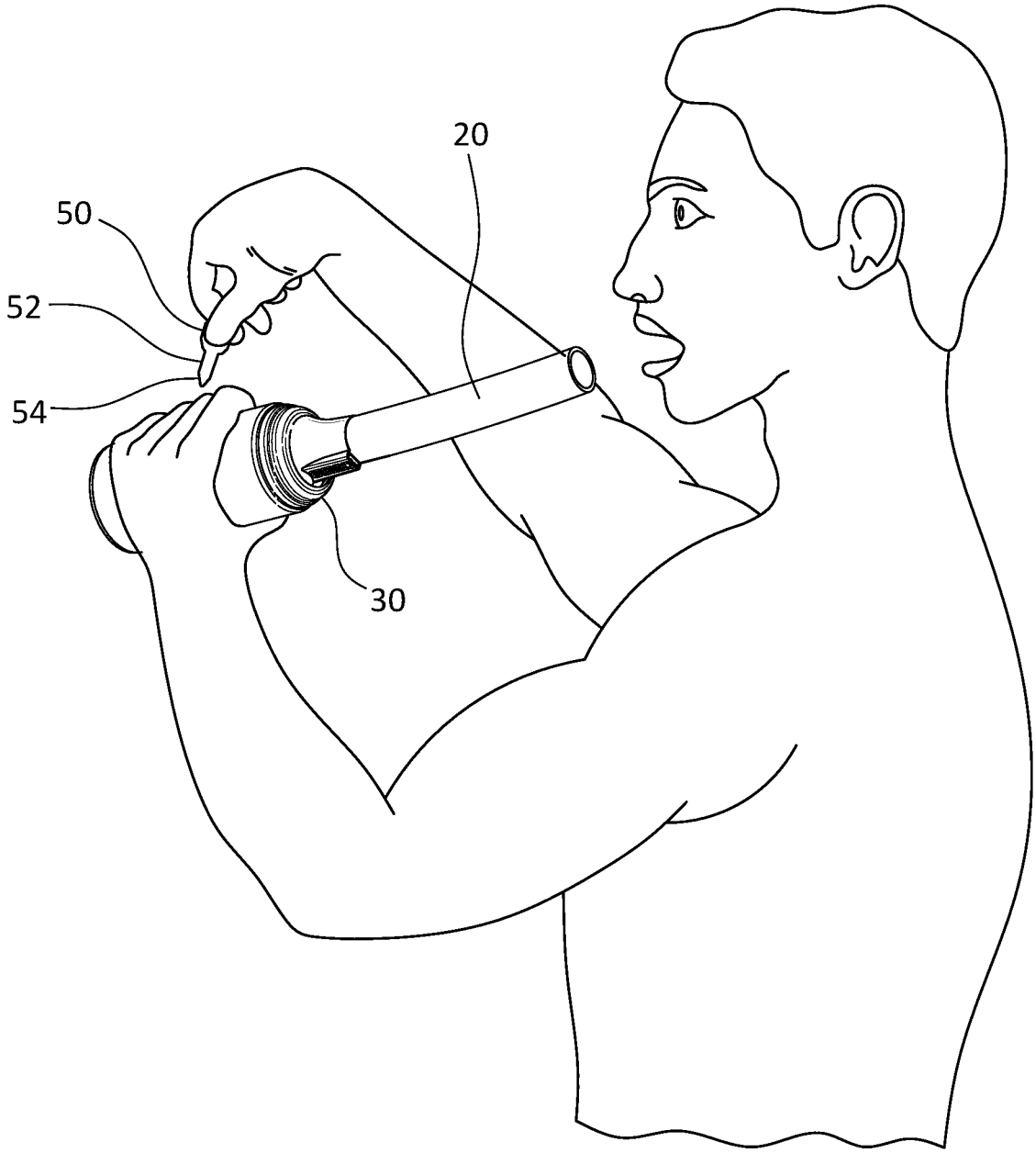
FIG. 9 is a side view of the portable drinking device of the present patent document mounted on a pressurized can with the user tilting the entire assembly and having removed the piercing element of the portable drinking device from its storage slot and positioning the piercing element to puncture a sidewall of the can. Either just before or immediately after the sidewall of the can is pierced with the piercing element, the entire assembly may be further tilted to position the tube of the portable drinking device to direct the flow of fluid from the can through the portable drinking device into a recipient's mouth.

FIG. 9 shows the portable drinking device 10, with the piercing element 50 removed from its storage area 40. As set forth above, the distal end 80 of cap 30 has the dimensions necessary to allow it to sit on top of the pressurized can 100 and completely cover the top of the can. Cap 30 may also have lip 82 formed on its distal end 80 the inner surface of which mates with the lip 102 on the top of can 100 as described above and as best seen in FIGS. 5 and 7. Cap 30 may be held in place on top of can 100 either by the user's hands and/or by lip 82 formed at the distal end 80 of cap 30 to mate with the lip 102 of can 100.

Prior to assembly of the portable drinking device on to the top of can 100, can 100 should be opened by either pulling the tab or using a device, such as a can opener, to open the can. Once pressurized can 100 has been opened, the portable drinking device 10 may be placed over the top of can 100, as shown in FIGS. 1-5, for use.

FIG. 9 further illustrate how the assembly of FIGS. 1-5 may be used. The entire assembly may be tilted slightly towards the user, with the tube 20 either close to or in the mouth of the user, and the bottom of can 100 located away from the user. While the assembly is in the slightly titled position, the piercing element 50 may be used to pierce or punch a hole into the distal end of the top face of can 100 (in the tilted position) to vent the contents of the can 100 to atmospheric pressure and allow the contents of can 100 to flow more readily into the user's mouth. In the embodiment shown, piercing element 50 is a key, which includes a shaft 52 with a pointed tip 54. The key 50 may be made from suitable metal, such as aluminum, or a hard plastic material.

Depending on the user's preference, the hole may be formed in the side of can 100 with the piercing element, either (i) just before the entire assembly is further tilted from the position shown in FIG. 9 so that the entire contents of the beverage contained in can 100 can rapidly flow through cap 30 and tube 20 into the user's mouth, or (ii) after the entire assembly is further tilted from the position shown in FIG. 9 so that the contents of the beverage contained in can 100 begin to flow through cap 30 and tube 20 into the user's mouth and a vacuum begins to form within can 100. In the latter, after a vacuum begins to form, the user may then use the piercing element 50 to form a hole in the side of the can 100 and release the vacuum in the can, thereby causing its contents to flow more rapidly into the user's mouth.

Although the beverage contained in the can 100 is usually carbonated, because of the rapid flow from the can 100 through the portable drinking device 10 and the relatively small hole created by piercing device 50 in can 100, minimal aeration and foam by-product from the carbonated beverage occurs.

Figure 8:
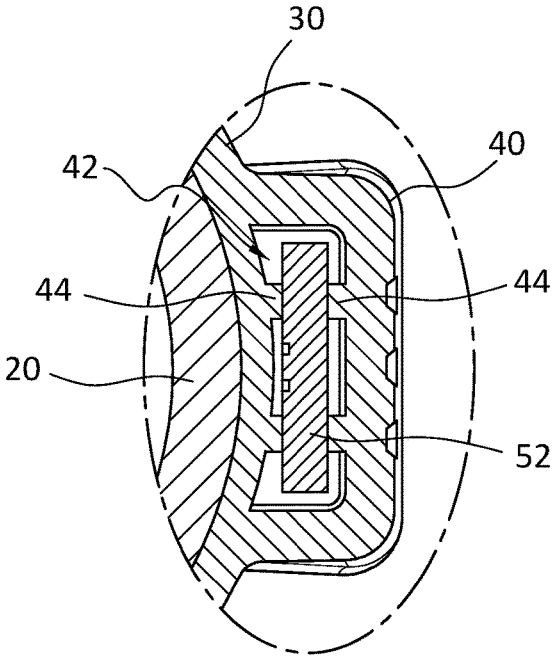
FIG. 8 is a cross-sectional view taken along line 8-8 in FIG. 5 through the piercing element and storage area.

As best seen in FIGS. 1-5 and 8, a portable drinking device may include a storage area 40 molded into the cap 30. Storage area 40 includes a receiving slot 42 that is sized to removably receive a portion of the piercing element 50. In the illustrated embodiment receiving slot 42 is sized to form an interference fit with the shaft 52 of key 50. In other embodiments, a different piercing device may be used and receiving slot 42 will need to be configured appropriately to removably retain the receiving device in the storage area 40 of cap 30. As best seen in FIG. 8, the interference fit in the present embodiment is created by two pairs of opposing protruding members 44 contained within receiving slot 42.

While shown in the illustrated embodiment as a receiving slot 42 having an open end, alternative arrangements are contemplated and form part of the current disclosure. For example, the receiving slot 42 may be configured to include a closeable portion, such as in the form of a strap or flap for enclosing all or a part of the piercing element 50 therein.

The present disclosure may be embodied in other specific forms without departing from its spirit or essential characteristics. The described embodiments are to be considered in all respects only as illustrative and not restrictive. The scope of the invention is, therefore, indicated by the appended claims rather than by the foregoing description. While certain embodiments and details have been included herein and in the attached disclosure for purposes of illustrating embodiments of the present disclosure, it will be apparent to those skilled in the art that various changes in the methods, products, devices, and apparatus disclosed herein may be made without departing from the scope of the disclosure or of the invention, which is defined in the appended claims. All changes which come within the meaning and range of equivalency of the claims are to be embraced within their scope.

What is claimed:

1. A portable drinking device for use with a pressurized beverage can comprising:

an elongated flexible tube having first and second open ends of about the same diameter; and a funnel-like cap having first and second open ends with the first end being smaller in diameter than the second end, the first end of the cap being configured to receive the second end of the tube so that the cap and tube can be affixed together, the second end of the cap being configured to removably receive a pressurized beverage can; a piercing element;

a piercing element storage area comprising a receiving slot formed in the cap and configured to removably receive at least a portion of the piercing element for storage, the receiving slot including a protruding member therein for retaining the piercing element.

2. The portable drinking device of claim 1, wherein the receiving slot is provided on a curved surface of the cap.

3. The portable drinking device of claim 1, wherein the piercing element is further tethered to the cap with a tethering element.

4. The portable drinking device of claim 1, wherein the piercing element is a key, bottle opener, pen or knife.

5. The portable drinking device of claim 1, wherein the piercing element is a key.

6. The portable drinking device of claim 5, wherein the receiving slot is configured to removably receive a shaft of the key and form an interference fit therewith.

7. The portable drinking device of claim 1, wherein the tube and the cap are removably affixed together via an interference fit.

8. The portable drinking device of claim 7, wherein the interference fit between the cap and the tube increases the further the tube is inserted into the cap.

9. The portable drinking device of claim 8, wherein the proximal end of the cap includes an annular shoulder protruding from an inner wall of the cap to provide a stop to prevent further insertion of the tube into the cap.

10. The portable drinking device of claim 1 where the tube is made from polypropylene, polyurethane, polyvinyl chloride (PVC), silicone and/or nylon.

11. The portable drinking device of claim 1, wherein the cap is made from a thermoplastic polymer and is injection molded.

12. The portable drinking device of claim 1, wherein the second end of the cap has a lip that when assembled with a top of the beverage can forms a temporary seal between the lip of the cap and the top of the beverage can.

13. The portable drinking device of claim 12, wherein the seal is formed as a result of an interference fit between an outer surface of the top of the can when the cap is assembled with the can.

14. The portable drinking device of claim 13, wherein an inner wall of the lip of the cap includes an annular recess sized to form an interference fit with a corresponding lip of the top of the can.

15. The portable drinking device of claim 14, wherein a protrusion is formed proximate a distal side of the annular recess for forming a snap seal with a distal edge of the lip of the can when the cap is assembled with the top of the can.

16. A portable drinking device for use with a pressurized beverage can comprising:

an elongated flexible tube having first and second open ends of about the same diameter; and a funnel-like cap having first and second open ends with the first end being smaller in diameter than the second end, the first end of the cap being configured to receive the second end of the tube so that the cap and tube can be affixed together, the second end of the cap being configured to removably receive a pressurized beverage can; a piercing element;

a piercing element storage area comprising a receiving slot formed in the cap and configured to removably receive at least a portion of the piercing element for storage, the receiving slot having a first open end and a second closed end opposite the first open end.

* * * * *